US007071400B1

(12) United States Patent
Lombardi

(10) Patent No.: US 7,071,400 B1
(45) Date of Patent: Jul. 4, 2006

(54) PERCUSSION COW BELL SUPPORT APPARATUS

(75) Inventor: Donald G. Lombardi, Westlake Village, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 11/030,732

(22) Filed: Jan. 7, 2005

(51) Int. Cl.
*G10D 13/02* (2006.01)

(52) U.S. Cl. ..... 84/402; 84/406

(58) Field of Classification Search ..... 84/402–409
See application file for complete search history.

(56) References Cited

U.S. PATENT DOCUMENTS 6,028,258 A * 2/2000 Hicks et al. ..... 84/421
6,307,136 B1 * 10/2001 Sikra et al. ..... 84/422.1

* cited by examiner

*Primary Examiner*—Kimberly Lockett
(74) *Attorney, Agent, or Firm*—William W. Haefliger

(57) ABSTRACT

Support apparatus for a percussion cow bell, to be operated or struck by a foot actuated beater unit, comprising a first support operatively connected to the cow bell and projecting for connection to and positioning by the beater unit, whereby the bell is positioned for impact by the beater, and means to block displacement of the cow bell in response to beater impact therewith.

8 Claims, 5 Drawing Sheets

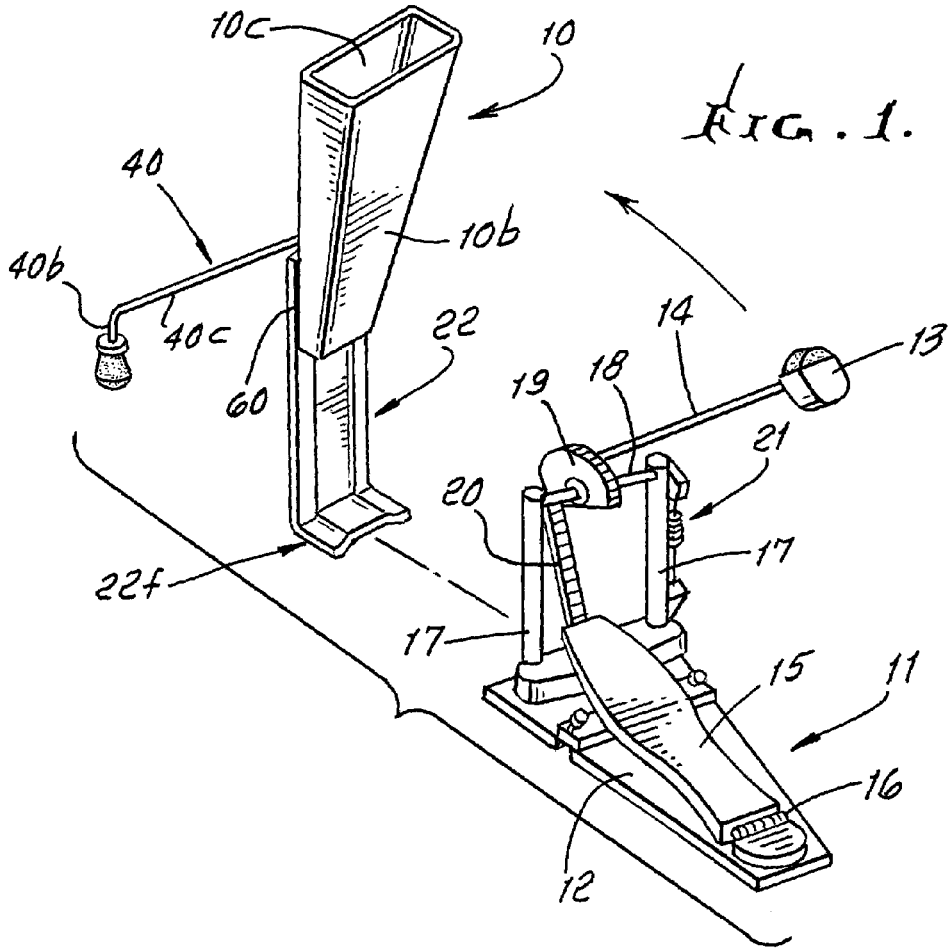
FIG. 1.
FIG. 4.
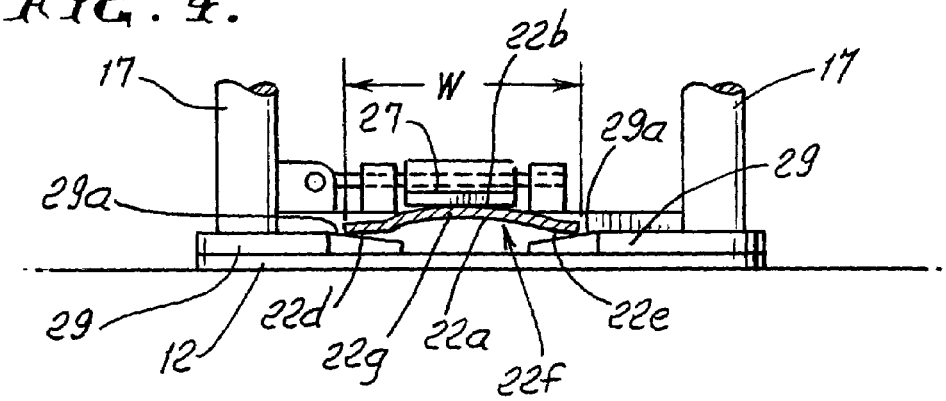

PERCUSSION COW BELL SUPPORT APPARATUS

BACKGROUND OF THE INVENTION

This invention relates generally to actuation of percussion cow bells, and more particularly to use of a foot actuated beater unit to achieve controlled striking of a percussion cow bell.

In the past, such cow bells were typically supported by equipment auxiliary to drum beating and/or to cymbals actuation. No way was known to achieve direct foot controlled beater striking of cow bell, in the simple effective manner as disclosed herein, and there is need for equipment to achieve this result.

SUMMARY OF THE INVENTION

It is a major object of the invention to provide apparatus meeting the above need. Basically, the support apparatus of the invention enables foot actuated beater striking of a percussion cow bell in such a way as to maintain the position of the cow bell, and comprises:

a) a first support operatively connected to the cow bell and projecting for connection to and positioning by the beater unit, whereby the bell is positioned for impact by the beater, b) and means to block displacement of the cow bell in response to beater impact therewith.

As will be seen, the beater unit typically has a base, and a clamp is provided on the base for clamping connection to the first support, as via a projecting bracket or strut integrally carried by the bell. That strut is typically directly connected to the metal of the cow bell, so as to add resonance to sound produced by striking of the bell.

A further object is to provide a projection configured for clamping connection to the beater unit, in spaced relation to the cow bell.

An added objective is to provide means acting as a brace to block displacement of the cow bell in response to beater impact with the cow bell; and such means typically comprises a second support operatively connected to the cow bell and projecting to engage a floor surface. The second support or strut is typically operatively connected to the cow bell and projects to engage a floor surface.

Yet another object is to provide:

a) a metallic strut capable of resonating b) means connecting the strut to the cow bell, to project endwise away from the cow bell for resonating when the cow bell is struck, thereby adding to the sharp sound of the cow bell when struck.

These and other objects and advantages of the invention, as well as the details of an illustrative embodiment, will be more fully understood from the following specification and drawings, in which:

DRAWING DESCRIPTION

FIG. 1 is a perspective view of preferred apparatus incorporating the invention, other forms being equivalent;

FIG. 4 is an enlarged fragmentary elevation taken on lines 4—4 of FIG. 2;

DETAILED DESCRIPTION

Figure 2:
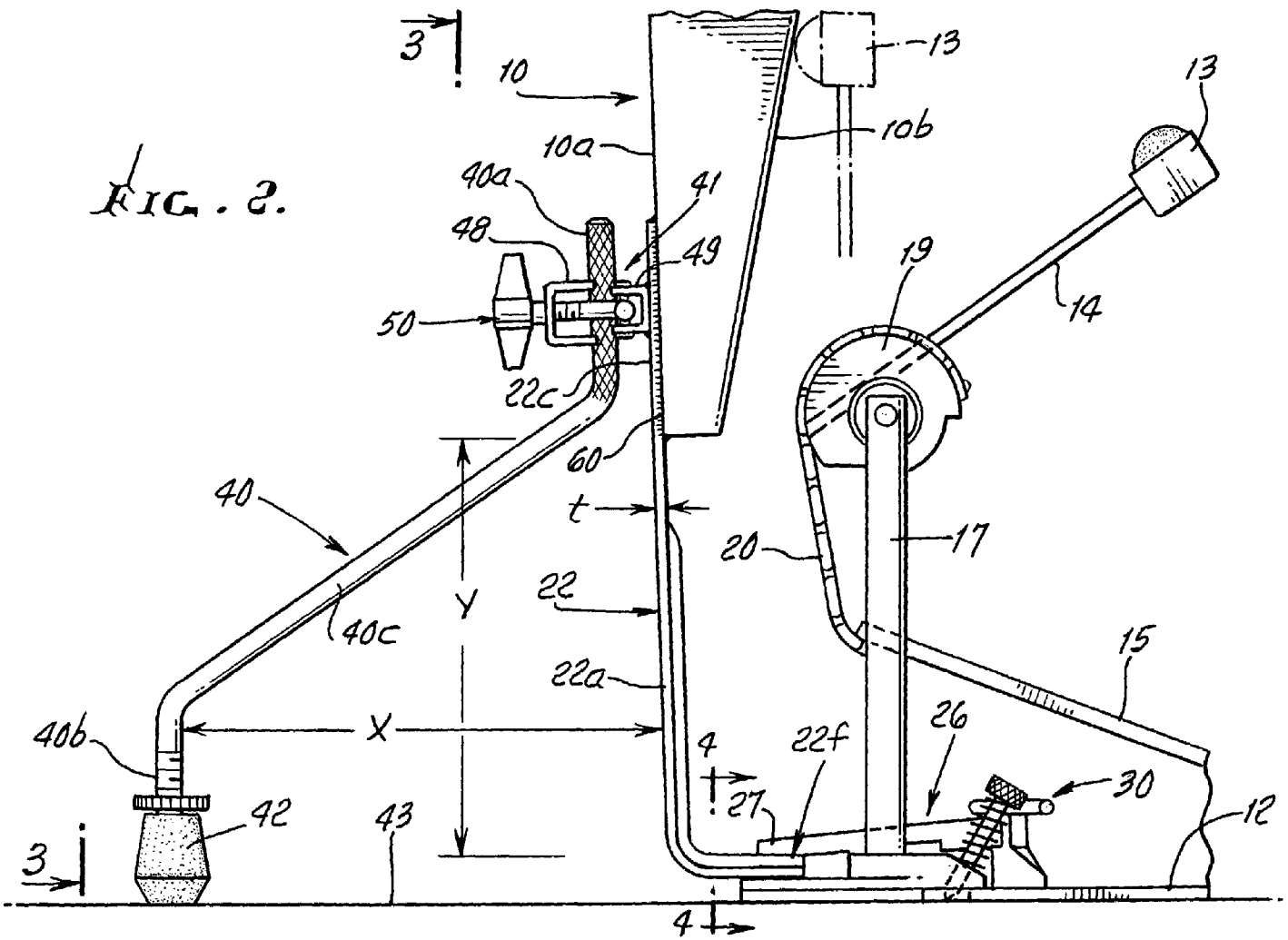
FIG. 2 is a side elevation of the FIG. 1 apparatus.

In the drawings, a metallic percussion cow bell 10 is located to be operated, i.e. struck, by a foot actuated beater unit 11. That unit includes a base 12, a beater 13 on an arm 14, and a foot pedal 15 to be foot operated to cause the arm and beater to be swung toward the bell, whereby the beater 13 forcibly strikes the cow bell as during a musical performance. Also shown are a hinge means 16 connecting the rear of the pedal to the base; pedestals 17, axle 18, sprocket 19 on the axle and supporting the arm to swing; a drive chain 20 entraining the sprocket and connected to the forward end of the pedal; and spring urged return mechanism 21 for returning the beater to FIG. 1 retracted position after the beater impacts the cow bell.

In accordance with the invention, the following are provided:

a) a first support operatively connected to the cow bell and projecting for connection to and positioning by the beater unit, whereby the bell is positioned for impact by the beater, b) and means to block displacement of the cow bell in response to beater impact therewith.

Elements a) and b) are preferred elements of the invention, and may take various forms. For example, the first support typically comprises a metallic strut 22 having metallic connection (as via welding or brazing at 60) to the rear metallic wall boa of the bell, whereby when the bell inclined wall 10*b* is impacted by the bester, projecting wall extent 22*a* of the strut will audibly resonate as part of, and with, the bell rear wall 10*a*. Thus, the strut acts to amplify the sound or tone of the struck bell, a desirable result in a typically amplified musical performance.

Figure 3:
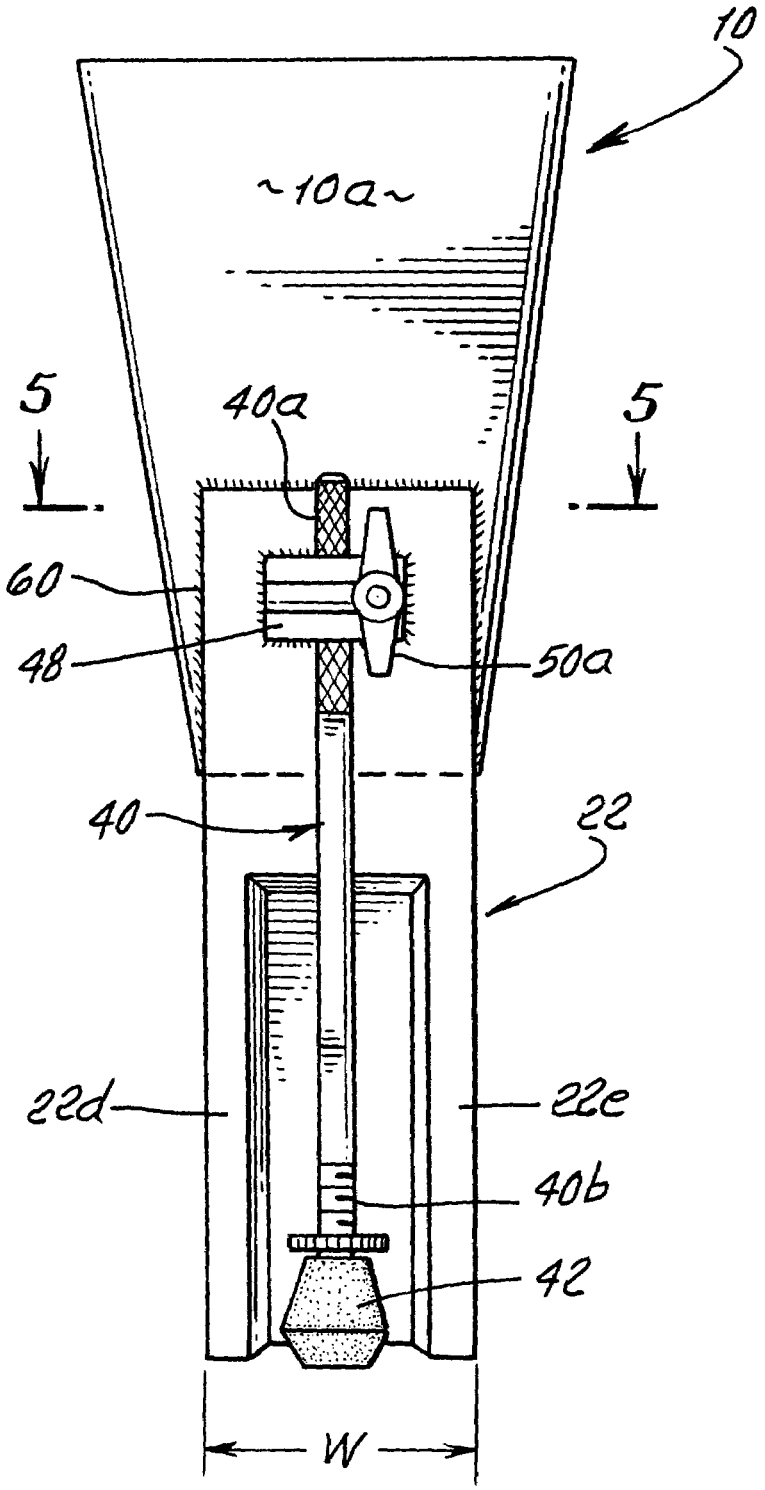
FIG. 3 is an end elevation taken on lines 3—3 of FIG. 2.
Figure 5:
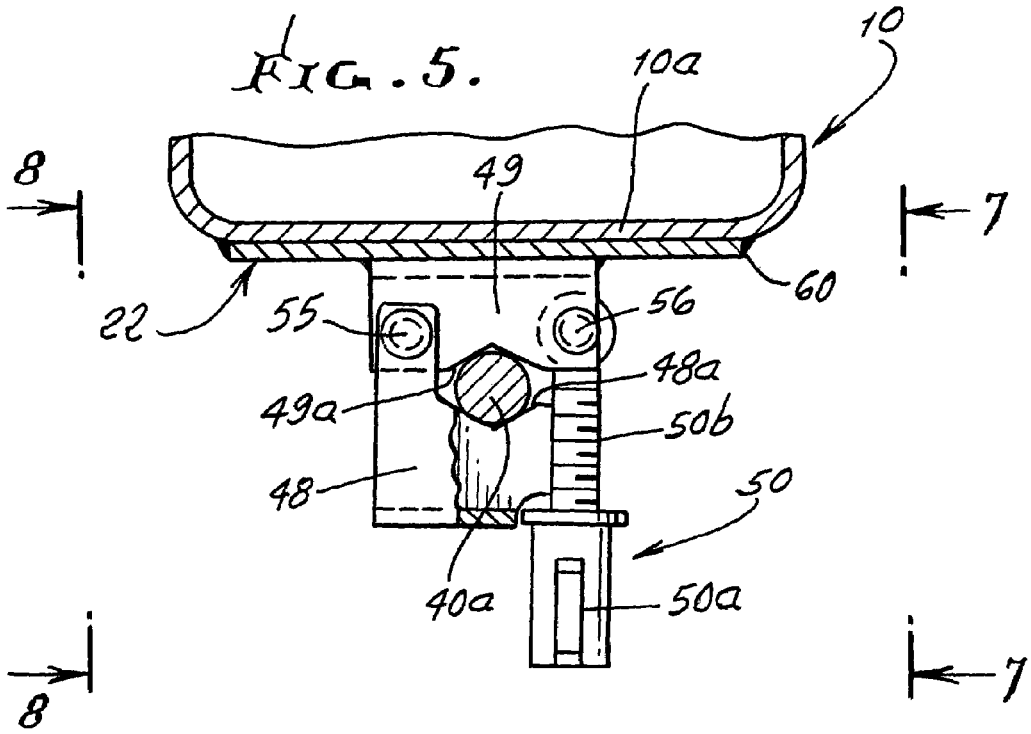
FIG. 5 is an enlarged fragmentary plan view taken on lines 5—5 of FIG. 3.

As shown in the Figures, the metallic strut 22 preferably has opposite sides 22*a* and 22*b*, of width 'w', which is substantially greater than strut thickness "t". The strut projects downwardly from the wall (i.e. integral) connection 60 of the strut upper end portion 22*c* to the lower rear wall of the upstanding cow bell, below mouth 10*c*. The strut lower portion is preferably stiffened, as by widthwise offset or deflected wall portions 22*d* and 22*e*, better seen in FIGS. 3 and 4. Those deflected of offset wall portions extend lengthwise of the strut for stiffening, and which acts to raise the frequencies of strut audible resonant vibrations, to add to cow bell sharp audible vibration.

The strut has a lower end portion 22*e*, preferably in the form of a rear right angle bend or flange 22*f* which projects toward 12 for clamping connection to the base 12 of unit 11, as for example is seen in FIGS. 1, 2 and 4. As shown, the hold down clamp 26 includes an upper clamping part 27 bearing downwardly on the laterally medial portion 22*g* of the strut bend 22*f*, causing the offset lateral portion 22*c* and 22*d* of the bend to be compressed against the upper tapered surfaces 29*a* of the base components 29. Therefore, downward tightening of the part 27 causes downward spring-like clamping deflection of the strut bend 22*f*, and for firmly resisting slippage by edge gripping of surfaces 29*a*, as during beater impact of the cow bell. Device 30 on the base is adjustable to cause selective downward displacement of the clamping part 27.

Another feature of the invention is the provision of means acting as a brace to block displacement of the cow bell in response to beater impact with the cow bell.

In the example shown, the second strut 40 is operatively connected to the cow bell and projects rearwardly to engage a floor surface. Thus, it acts as a brace to block displacement of the cow bell in response to beater impact with the cow bell.

The illustrated second strut has an upper end portion 40*a* connected at 41 to the cow bell, and a lower portion 40*b* having a terminal 42 to engage the floor 43. Terminal 42 may comprise a rubber stop to frictionally engage the floor surface. The strut 40 has an angled intermediate extent 40*c* between 40*a* and 40*b*, whereby 40*b* is rearwardly offset from strut 22 by an amount X related to length Y of strut 22, as follows:

$$2X>Y>1/2X$$

whereby firm reliable stability of the cow bell, against rearward deflection, is achieved as during heavy repeated impacting of the cow bell.

Figure 6:
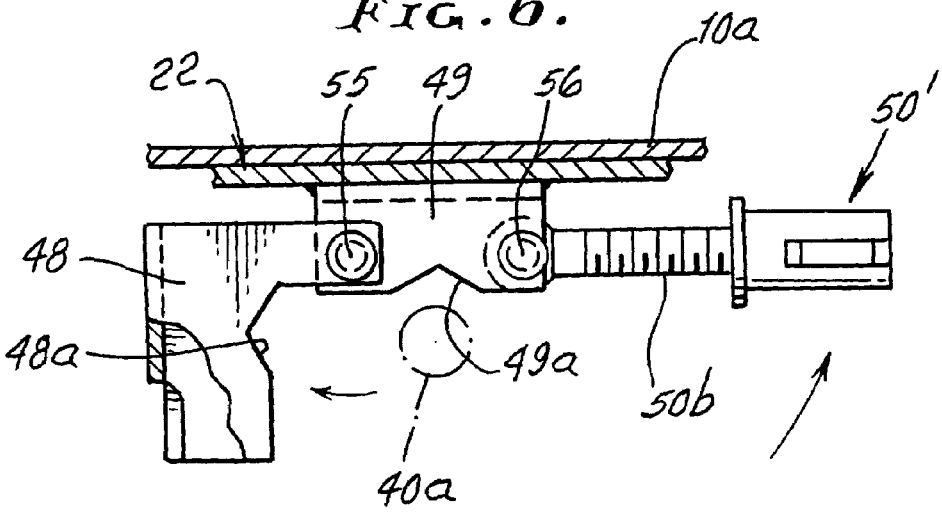
FIG. 6 is view like FIG. 5, but showing an open clamp condition.
Figure 7:
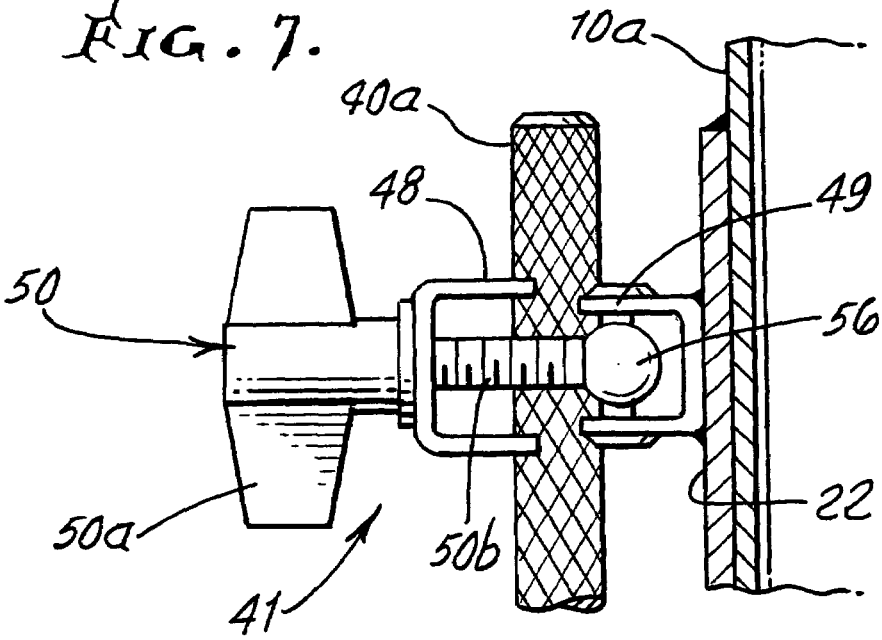
FIG. 7 is an elevation taken on lines 7—7 of FIG. 5.
Figure 8:
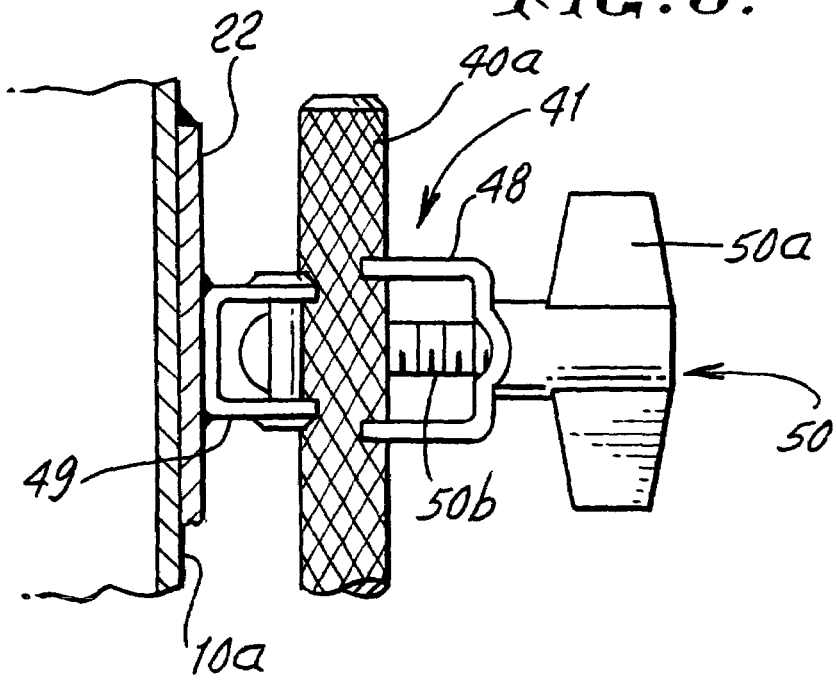
FIG. 8 is an elevation taken on lines 8—8 of FIG. 5.

The connection at 41 may be height adjustable, and in the preferred manner, as shown. Strut 40 upper vertical portion 40*a* is knurled, and fits between clamping parts or jaws 48 and 49 defining V-shaped recesses 48*a* and 49*a* between which 40*a* is received. Those jaws are clamped toward each other by an actuator 50, rotated by handle 50*a* to cause threaded stem 50*b* to advance hinged jaw 48 toward jaw 49. Actuator 50, when loosened, can be swung away to position 50' in FIG. 6 to allow quick re-positioning of the strut 40 vertical portion 41*a*. Note jaw 48 pivot at 55, and actuator 50 pivot at 56.

I claim:

1. Support apparatus for a percussion cow bell, to be operated or struck by a foot actuated beater unit, comprising a) a first support operatively connected to the cow bell and projecting for connection to and positioning by the beater unit, whereby the bell is positioned for impact by the beater, b) and means to block displacement of the cow bell in response to beater impact therewith, c) said first support comprises a metallic strut having metallic connection to the cow bell, to resonate in response to beater impact with the cow bell, d) the strut having a projection configured for clamping connection to said unit, in spaced relation to the cow bell, e) and including said beater unit which has a base, and a clamp on the base having clamping connection to said projection.

2. The combination of claim 1 including means acting as a brace to block displacement of the cow bell in response to said beater impact with the cow bell.

3. The combination of claim 2 wherein said means comprises a second strut operatively connected to the cow bell and projecting to engage a floor surface.

4. Support apparatus for a percussion cow bell, to be operated or struck by a foot actuated beater unit, comprising a) a first support operatively connected to the cow bell and projecting for connection to and positioning by the beater unit, whereby the bell is positioned for impact by the beater, b) and means to block displacement of the cow bell in response to beater impact therewith, c) and including means acting as a brace to block displacement of the cow bell in response to said beater impact with the cow bell, d) the first support comprising a first strut, and wherein said means acting as a brace comprises a second strut operatively connected to the cow bell and projecting to engage a floor surface.

5. The combination of claim 1 wherein the strut is connected to the cow bell, to project endwise away from the cow bell for resonating when the cow bell is struck, thereby adding to the sound of the cow bell when struck.

6. The apparatus of claim 5 including a support connected to the strut to support the strut and the cow bell for impact of the cow bell.

7. Support apparatus for a percussion cow bell, to be operated or struck by a foot actuated beater unit, comprising a) a first support operatively connected to the cow bell and projecting for connection to and positioning by the beater unit, whereby the bell is positioned for impact by the beater, b) and means to block displacement of the cow bell in response to beater impact therewith, c) said first support comprises a metallic strut having metallic connection to the cow bell, to resonate in response to beater impact with the cow bell, d) the strut having a projection configured for clamping connection to said unit, in spaced relation to the cow bell, e) and wherein the strut has an offset wall portion or portions extending lengthwise of the strut and to said projection, for stiffening of the strut.

8. The combination of claim 4 wherein the second strut projects away from the first support at an extent X, related to the length Y of a first strut defined by the first support where $$2X>Y>1/2X.$$

* * * * *